US010494128B2

(12) United States Patent
Krakers

(10) Patent No.: US 10,494,128 B2
(45) Date of Patent: Dec. 3, 2019

(54) DEVICE FOR THE FILLING AND/OR CLOSING OF CONTAINERS HAVING A DRIVE ACTUATOR DECONTAMINATION BOX

(71) Applicant: JBT Food & Dairy Systems B.V., Amsterdam (NL)

(72) Inventor: Bernardus Antonius Johannes Krakers, XK Uitgeest (NL)

(73) Assignee: JBT Food & Dairy Systems B.V., Amsterdam (NL)

( * ) Notice: Subject to any disclaimer, the term of this patent is extended or adjusted under 35 U.S.C. 154(b) by 357 days.

(21) Appl. No.: 15/524,563

(22) PCT Filed: Nov. 2, 2015

(86) PCT No.: PCT/NL2015/050763
§ 371 (c)(1),
(2) Date: May 4, 2017

(87) PCT Pub. No.: WO2016/072847
PCT Pub. Date: May 12, 2016

(65) Prior Publication Data

US 2018/0170601 A1 Jun. 21, 2018

(30) Foreign Application Priority Data

Nov. 4, 2014 (NL) ..... 2013735

(51) Int. Cl.
*B65B 55/10* (2006.01)
*B65B 55/02* (2006.01)
(Continued)

(52) U.S. Cl.
CPC ..... *B65B 55/10* (2013.01); *B65B 7/2835* (2013.01); *B65B 55/025* (2013.01); *B67B 3/20* (2013.01);
(Continued)

(58) Field of Classification Search
CPC ..... B65B 7/2835; B65B 55/10; B65B 55/025; B65B 55/04; B67B 3/20
See application file for complete search history.

(56) References Cited

U.S. PATENT DOCUMENTS 7,536,839 B2 5/2009 Kemper et al.

FOREIGN PATENT DOCUMENTS

CN 104083781 A 10/2014
DE 2149122 A1 4/1973
(Continued)

OTHER PUBLICATIONS

International Search Report and Written Opinion dated Feb. 29, 2016, issued in corresponding International Application No. PCT/NL2015/050763, filed Nov. 2, 2015, 11 pages.
(Continued)

*Primary Examiner* — Donald R Spamer
(74) *Attorney, Agent, or Firm* — Christensen O'Connor Johnson Kindness PLLC

(57) ABSTRACT

A filling/closing device comprises a conditioned zone 2 for performing operations to containers. A drive actuator 11 of an operating system is movable with into and out of the zone. The drive actuator extends through a decontamination box 14 with an outer suction chamber 15 and an inner sterilization chamber 16 is provided. A sterilization medium supply 17 connects to the sterilization chamber, and a discharge 22 connects to the suction chamber. One or more outflow gaps 20, 21 are provided which connect the sterilization to the suction chamber. According to the invention an inner inflow gap 24 is provided in between the suction chamber and the drive actuator which connects the zone to the suction chamber.

18 Claims, 5 Drawing Sheets

(51) Int. Cl.

| | |
|---|---|
| ***B65B 7/28*** | (2006.01) |
| ***B67B 3/20*** | (2006.01) |
| *B67C 3/22* | (2006.01) |

(52) U.S. Cl.
CPC ..... *B67B 2201/08* (2013.01); *B67C 2003/228* (2013.01)

(56) References Cited

FOREIGN PATENT DOCUMENTS

| | | | |
|---|---|---|---|
| DE | 4038889 | C2 | 1/1992 |
| EP | 2103528 | A1 | 9/2009 |
| JP | 2003-102809 | A | 4/2003 |

OTHER PUBLICATIONS

Chinese Office Action and Search Report dated Sep. 4, 2018, issued in corresponding Chinese Application No. 201580058937/, filed Nov. 2, 2015, 7 pages.

17
11
15
35
16
22
11
17
16
15

3
2

DEVICE FOR THE FILLING AND/OR CLOSING OF CONTAINERS HAVING A DRIVE ACTUATOR DECONTAMINATION BOX

The invention relates to a device for the filling and/or closing of containers in a conditioned zone, in particular under sterile or aseptic conditions, which device is equipped with a decontamination box surrounding part of a drive shaft of some kind of operating system destined to perform operations to the containers.

If for example it is desired to mount a cap onto a container like a bottle, then a rotating and translating movement of a capping organ is necessary. A part of a drive shaft (also called a turret) will then continuously penetrate into and out of a conditioned zone of the filling and/or closing device. If this device is operated aseptically, the drive shaft will then continuously penetrate an aseptic zone. To maintain the required aseptic environment, an aseptic barrier is needed to guarantee a hygienic closure between the conditioned zone in which the bottle is closed and the environment, in particular the outside world.

For example U.S. Pat. No. 6,495,111 shows a "sterile" tunnel for aseptically operating packing machines, in which a drive shaft of some kind of operating system is guided through a telescopic set of tubes which together form an adjustable decontamination box around the drive shaft. The box is able to telescope inward and outward together with the drive shaft moving into and out of the tunnel. During operation sterile air flows out of the tunnel into the telescopic set of tubes and from there into the environment. The outflow into the environment on the one hand takes place via an outflow gap which is present in between the tubes sliding over one another, and on the other hand takes place via outflow openings which have been specifically provided at an upper side of the box. This is done in order to prevent that all the sterile air leaves the box halfway via the outflow gap, but also flows partly alongside the upper part of the drive shaft.

The principle of this telescopic decontamination box is a free flow system. Because of the telescopic translating movement of the tubes into and out of each other, a pumping effect might occur. This influences the flow balance, especially at high speeds. A pre-sterilisation of the drive shaft occurs during a pre-production phase. During a production phase, the flow of sterilisation air out of the working area inside the tunnel then needs to maintain sterility of the drive shaft. A disadvantage with this however is that both this maintaining of the sterility during the production phase as well as the pre-sterilization during the pre-production phase of the drive shaft and the tubes are done indirectly. The sterilisation air in both situations passes the drive shaft after already having flown through the working area inside the tunnel. The activeness of the sterilization medium inside the tubes is therefore doubtful after having already been exposed in other areas first.

As another example U.S. Pat. No. 7,536,839 shows a machine for closing bottles with sterile caps, in which around a drive shaft of a cap screwing module a decontamination box is provided. The decontamination box comprises a sterilization chamber which is supplied with sterile air via a supply. The sterilization chamber itself is placed inside a so-called screwing chamber. An upper part of the screwing module also extends through this screwing chamber. Underneath the sterilization chamber and screwing chamber a conditioned working zone is present where the caps are placed on the bottles. During operation this working zone is supplied with sterile air.

A disadvantage with this construction is that during operation air flows out of the sterilization chamber into the working zone. In case any organisms and spores still exist after pre-sterilization in the sterilization chamber, or in the case that contamination enters the sterilization chamber from the screwing module, it will flow to the working zone and there might contaminate the cap, bottle and/or product.

The present invention aims to overcome one or more of the above mentioned disadvantages at least partly, or to provide a usable alternative solution. In particular the invention aims to provide a device of which the required operating conditions in a conditioned zone can more easily be guaranteed even with driving shaft parts of an operating system frequently penetrating into and out of this zone.

This aim is achieved by a device for the filling and/or closing of containers, in particular under sterile or aseptic conditions, according to claim 1. The device comprises a conditioned zone inside which operations to containers are to be performed, like for example picking and placing, flushing, sterilizing, drying, filling and/or closing of the containers. The conditioned zone is connectable to or equipped with a supply for feeding conditioning medium thereto. An operating system is provided for performing the mentioned operations to the containers. This operating system has a drive unit and a drive shaft. The drive shaft can connect to a suitable operating organ which is designed to perform the aimed operation to the container. The drive unit is at least partially, and in particular in its entirety, placed in an environment outside the conditioned zone, whereas the drive shaft is movable with at least a driving shaft part into and out of the zone. A decontamination box surrounds at least part of the drive shaft for forming a sterilization barrier there around. The box, preferably connects to the conditioned zone, in particular to some kind of cover organ which at least partly covers the conditioned zone. The box comprises an outer suction chamber and an inner sterilization chamber. The sterilization chamber lies at least partly inside the suction chamber, and in particular can be entirely enclosed/encompassed by it. The drive shaft extends at least partly through the suction and sterilization chambers. A sterilization medium supply is connectable or connected to the sterilization chamber for supplying sterilization medium thereto. A media discharge is connectable or connected to the suction chamber for discharging media to outside the decontamination box. At least one outflow gap is provided which connects the sterilization chamber to the suction chamber such that the sterilization medium which is fed into the sterilization chamber is able to flow into the suction chamber after having had the opportunity to sterilize that part of the drive shaft which moves back and forth there through. According to the inventive thought a so-called inner inflow gap is provided which extends along the drive shaft in between walls delimiting the suction chamber and walls delimiting the conditioned zone.

The suction chamber is able to form a transition towards the conditioned zone, and be a kind of buffer between the sterilization chamber and the conditioned zone. Owing to this it can now advantageously be obtained that all the sterilization media which are supplied to the sterilization chamber are drained off via the suction chamber and from there out of this suction chamber via the media discharge. For achieving this, the sterilization medium in particular is supplied into the sterilization chamber at a pressure which is higher than a suction pressure at which the media are sucked out of the suction chamber.

With this it can even be effected that small amounts of the conditioning media flow out of the conditioned zone into the suction chamber and from there are sucked out also via the media discharge. For achieving this, the media in particular are sucked out of the suction chamber at a pressure which is lower than a pressure at which the conditioning medium is supplied into the zone. Any medium is then prevented from flowing out of the suction chamber along the drive shaft into the conditioned zone. The flow out of the conditioned zone towards the suction chamber prevents any decontamination, like organisms, to enter the conditioned zone along the drive shaft.

Before actual operation of the device (production), a sterilization in place (SIP) can be performed with a suitable sterilization medium like a vaporized Hydrogen Peroxide Vapour (HPV) or the like. After this pre-sterilization, the driving shaft part that will travel into and out of the conditioned zone is sterile. During production the flow of sterilization medium along the drive shaft can be kept active by continuous supply of a likewise suitable sterilization medium, like HPV, to the sterilization chamber.

The decontamination box according to the invention thus always is able to have an active flow of sterilization medium along the drive shaft both during pre-sterilization as well as during production which continuously decontaminates the drive shaft. The invention offers a substantially free flow system which does not have some kind of pumping effect, and therefore is independent to whatever frequency of a translating speed of the drive shaft. A relevant part of the drive shaft can thus be directly and equally exposed to the sterilization medium which is a very effective and reliable process. This inventive type of decontamination box is well able to provide a controlled environment and well balanced system to collect and exhaust all media to be discharged at one desired location, that is to say via the media discharge, while at the same time non-sterile parts of the operating system never are able to enter the conditioned zone of the device along the drive shaft.

A longitudinal dimension of the sterilization and suction chambers, in particular in a direction of translational movement of the drive shaft, preferably is chosen larger than a maximum travel of the drive shaft in this movement direction during operation. This may help to guarantee that a remaining "non-sterile" part of the drive shaft which lies outside the chambers then never will be able to enter the conditioned zone of the device.

The at least one outflow gap which connects the sterilization chamber to the suction chamber can be provided at different positions, for example at an upper or lower end of the chamber or even at a sideways position thereof. Important is that the sterilization medium has enough time to truly sterilize the drive shaft or keep the drive shaft sterilized. Preferably the inner sterilization chamber is enclosed/encompassed by the suction chamber in such a way that first and second outflow gaps are obtained at opposing ends relative to each other in between walls delimiting the sterilization chamber and the drive shaft. Those first and second outflow gaps then both connect the sterilization chamber directly to the suction chamber in such a way that considerable amounts of the sterilization medium can easily and quickly keep on flowing along the drive shaft during operation.

In a preferred embodiment the sterilization chamber is delimited by a bushing inside which a distribution tube is placed. The sterilization medium supply then connects to a space lying in between the bushing and the distribution tube. During operation this space is supplied with the sterilization medium and with the aid of the inner distribution tube this sterilization medium can be distributed substantially equally over the surface of that part of the drive shaft which at that moment is present inside the sterilization chamber.

In a further embodiment the distribution tube comprises a plurality of openings for sterilization medium to flow through towards the drive shaft. The inner tube can for example be perforated.

In addition or in the alternative the distribution tube may fit with a play of between 1-5 millimetres, for example about 3 millimetres, around the drive shaft. The play between the tube and the drive shaft in particular is chosen such that a certain minimum flow of sterilization medium along the drive shaft can be obtained. For example the device is constructed and operated such that a flow of at least 1-2 m/s, for example about 1.5 m/s, at pressure differences of between 5-10 Pa, can be obtained during operation. This minimum flow is generally acceptable to assume that no organisms will be able to move counter-flow. The mentioned play furthermore in particular can be chosen such that if the decontamination box is periodically flushed with a liquid medium like water, the play prevents the liquid medium for its capillary behaviour creating undesired connections between the chambers and the conditioned zone and then disturb the free flow balance. For this also a play of between 1-5 millimetres, for example about 3 millimetres, suffices. The play may be larger, however a larger flow rate of the sterilization medium would then be needed to maintain the acceptable minimum flow of for example at least 1.5 m/s and is therefore inefficient.

In another embodiment an outer inflow gap is provided in between walls delimiting the suction chamber and the drive shaft which outer inflow gap connects the environment to the suction chamber. By then having the media be sucked out of the suction chamber at a pressure which is lower than a pressure in the environment, the media can be prevented from flowing out of the suction chamber along the drive shaft into the environment. All the media which have entered the suction chamber, that is to say the sterilization medium, the conditioning medium and environmental air or the like, can be drained off out of the suction chamber via the media discharge.

The invention is applicable to all kinds of operating systems having moving parts that penetrate the conditioned zone. Examples of such operating systems are pick and place units, filling nozzles, capping units, support handles for executing movements within the conditioned zone, etcetera. The movement of the drive shafts of the operating system can be translational, rotational, axial or a combination thereof.

Further preferred embodiments are stated in the dependent subclaims.

The invention also relates to a method for operating such a device.

The invention shall be explained in more detail with reference to accompanying drawings in which.

Figure 2:
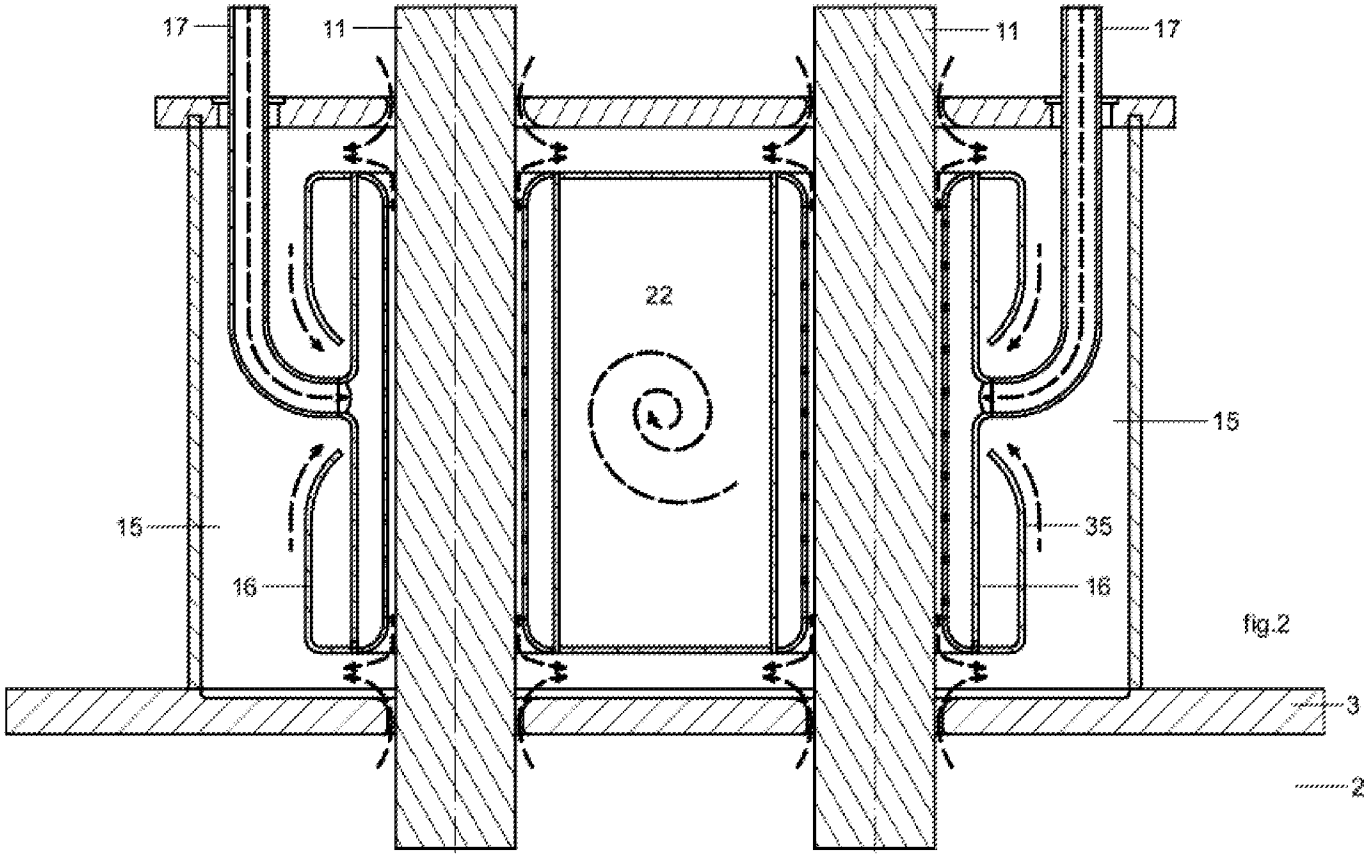
FIG. 2 shows an enlarged schematic view of a variant.
Figure 3A:
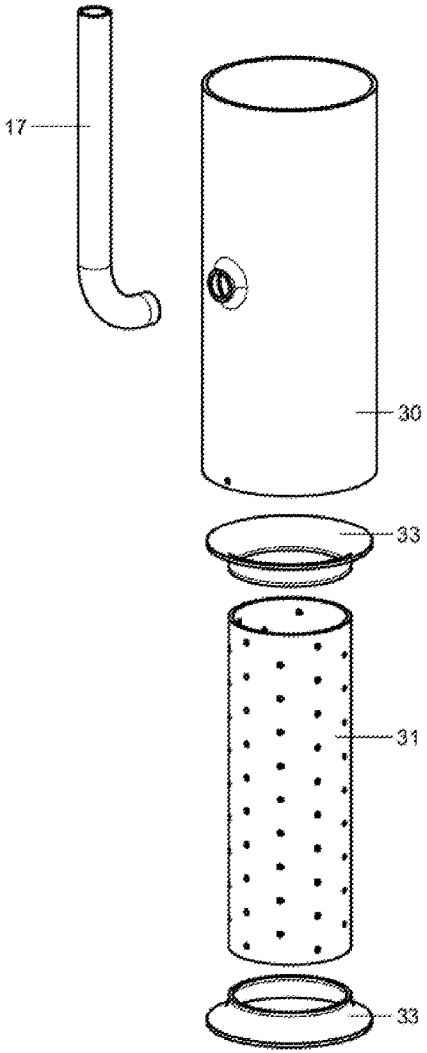
FIG. 3 shows a further enlarged view of a detail of FIG. 2.
Figure 3:
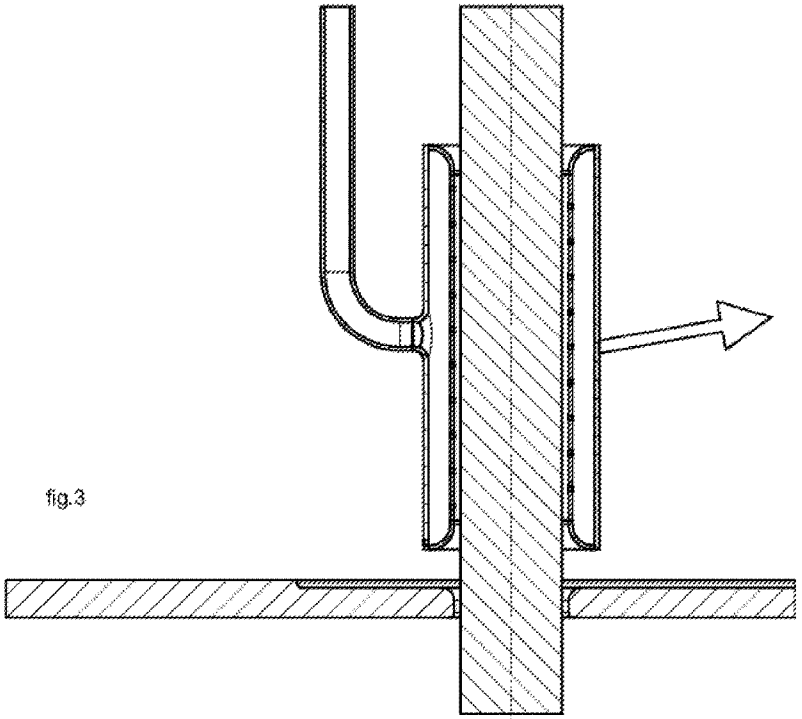
Figure 4:
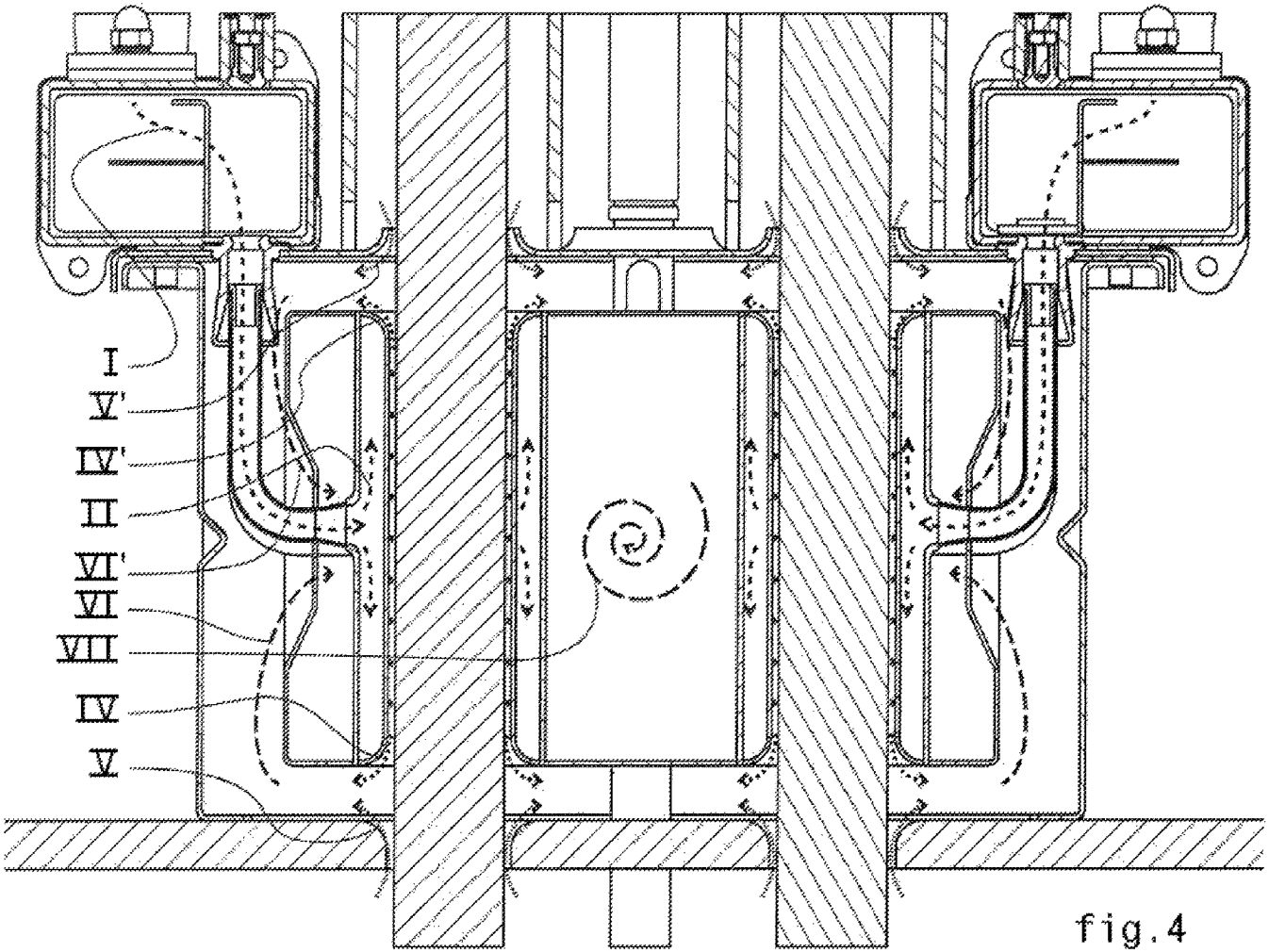
Figure 4A:
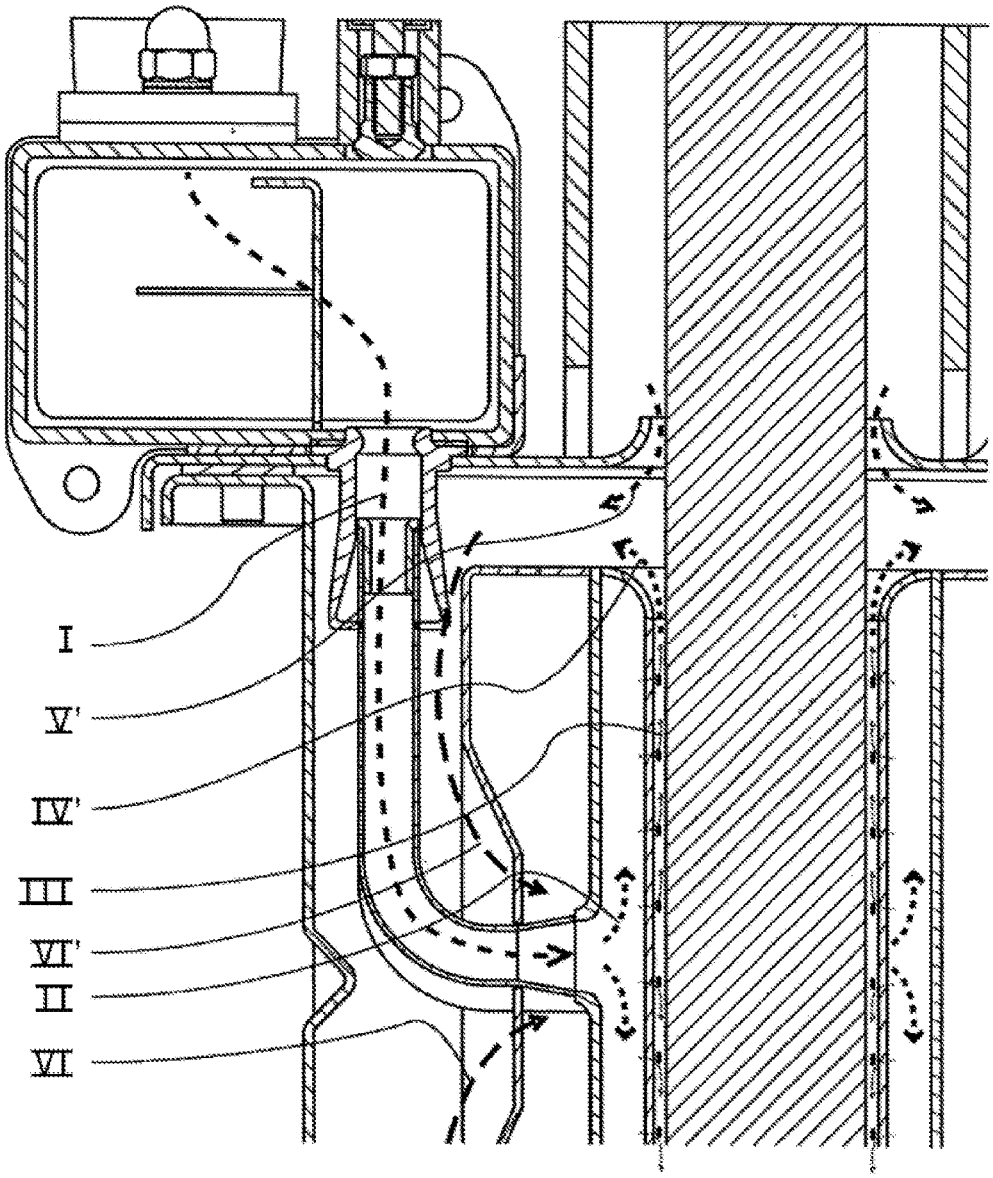

FIG. 3*a* shows an exploded view of the sterilization chamber of FIG. 3;

FIG. 4 shows a cross-sectional view of FIG. 2 with some more detail; and FIG. 4*a* shows an enlarged view of FIG. 4.

Figure 1:
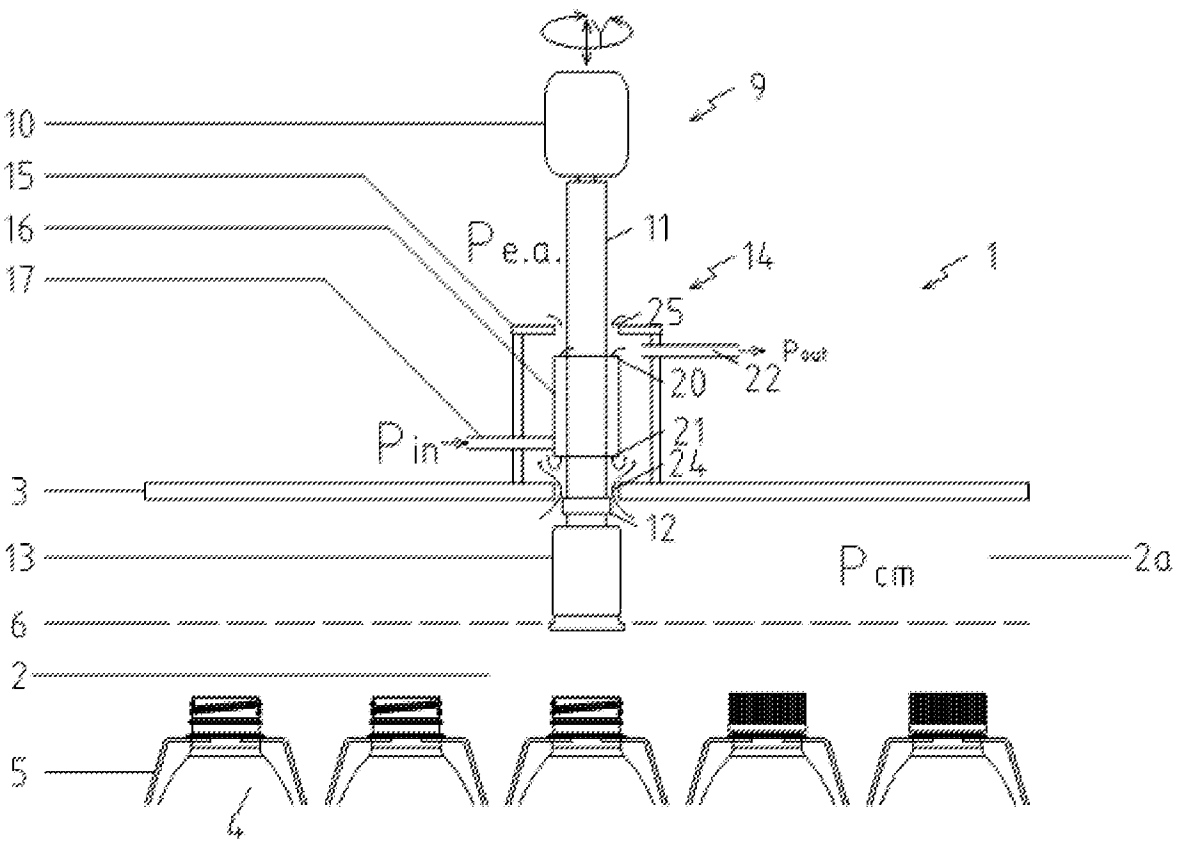
FIG. 1 shows a schematic view of an embodiment of a device according to the invention also showing some preferred flow patterns for the respective media.

In FIG. 1 the device in its entirety has been given the reference numeral 1. The device 1 comprises an aseptic zone 2 which at its upper side is delimited by a roof top 3. Bottles 4 are transported with their upper ends through the zone 2 by means of bottle carriers 5. During operation a conditioning medium is supplied into the zone 2 by means of a conditioning medium supply (not shown) connecting to an upper part 2*a* of the zone 2. A grid plate 6 is provided for equally distributing the conditioning medium throughout the zone 2 over the upper ends of the bottles 4.

On top of the device 1, in an environment outside the conditioned zone 2, a capping unit 9 is mounted. The unit 9 comprises a servo drive unit 10 which is able to translate a drive shaft 11 up and down along an y-axis as well as to rotate it around this y-axis, in order to place and screw suitable caps, lids, or the like, on top of the bottles 4. For this the drive shaft 11 at its lower end is provided with an operating organ 12 which is connectable to a chuck 13 present inside the conditioned zone 2.

The drive shaft 11 extends through a decontamination box 14 which comprises an outer suction chamber 15 and an inner sterilization chamber 16. The sterilization chamber 16 lies fully inside the suction chamber 15 and as it where is enclosed/encompassed by it. A sterilization medium supply 17 is connected to the sterilization chamber 16. The sterilization medium supply 17 is connected to a reservoir from out of which sterilization medium can be supplied, for example by means of a pump, at a pressure Pin, into the sterilization chamber 16. The drive shaft 11 partly extends through the sterilization chamber 16. At upper and lower ends of the sterilization chamber 16, first and second outflow gaps 20, 21 are provided leading into the suction chamber 15. The gaps 20, 21 are each formed by a play left free in between walls delimiting feed-through openings in the sterilization chamber 16 and an outer circumferential wall of the drive shaft 11.

The suction chamber 15 is equipped with a media discharge 22. The media discharge 22 is connected to a reservoir towards which media sucked out of the chamber 15 can be transported, for example by means of a pump, at a pressure Pout, out into the discharge 22. Besides partly extending through the sterilization chamber 16, the drive shaft 11 also partly extends through the suction chamber 15. At upper and lower ends of the suction chamber 15, inner and outer inflow gaps 24, 25 are provided leading into the suction chamber 15. The gaps 24, 25 are each formed by a play left free in between walls delimiting feed-through openings in the suction chamber 15/roof top 3 and an outer circumferential wall of the drive shaft 11.

During operation, the supplying pressure Pin of the sterilization medium supplied to the sterilization chamber 16 preferably is controlled such that it is higher than the discharging pressure Pout of the media sucked out of the suction chamber 15. Furthermore, during operation, the discharging pressure Pout of the media sucked out of the suction chamber 15 preferably is controlled such that it is lower than the supplying pressure Pc.m. of the conditioning medium supplied to the conditioned zone 2. Furthermore, during operation, the discharging pressure Pout of the media sucked out of the suction chamber 15 preferably is controlled such that it is lower than the pressure Pe.a. of the environmental air surrounding the device 1. For regulating those aimed pressure differences:

$$Pin > Pout \quad (1)$$

$$Pout < Pc.m. \quad (2)$$

$$Pout < Pe.a. \quad (3)$$

a control unit can be provided for steering respective valves, pumps, and the like connecting to the various media supplies and discharges.

Owing to the described provisions and pressure differences, flow patterns of the various media occur as indicated in FIG. 1. In particular it can be seen that the sterilization medium distributes itself inside the chamber 16, from there starts to flow along the shaft 11, then flows via the gaps 20, 21 out of the chamber 16 into the chamber 15, where it is mixed with some conditioning medium flowing via the gap 24 out of the conditioned zone 2 into the chamber 15, and where it is mixed with some environmental air flowing via the gap 25 out of the environment into the chamber 15. This mixture of the three respective media then flows out of the chamber 15 via the discharge 22.

In FIG. 2-4 similar components have been given the same reference numerals as in FIG. 1. In this embodiment a set of two adjacent drive shafts 11 is shown. For each drive shaft 11 an own dedicated sterilization chamber 16 is provided. Those two sterilization chambers 16 are housed inside one common suction chamber 15, having a central common media discharge 22.

Each sterilization chamber 16 at its outer side is delimited by a cylindrical bushing 30. Inside the bushing 30 a distribution tube 31 is placed. See FIG. 3*a*. Between the bushing 30 and the tube 31 a distribution space 32 is present. The supply 17 connects to this space 32. The tube 31 is formed by a perforated body, each perforation forming an opening for sterilization medium to flow through towards the drive shaft 11. The dimensions of the openings can be varied, and for example be made larger the further away they lie from the supply 17.

The tube 31 is held centred inside the bushing 30 by means of two curved end rings 33. The curved shape of the rings 33 helps to smoothly guide the sterilization medium flowing out of the chamber 16 into the chamber 15. For the same purpose, curved flow guides 35 are provided at outer sides of the bushing 30 and leading towards the common media discharge 22.

The distribution tube 31 fits with a play of preferably a few millimetres, and for example be about 3 millimetres, around the drive shaft 11. The gaps 20, 21, 24, 25 have been given similar smallest width dimensions of a few millimetres. Together the defined play and gaps create equal flows along the drive shaft 11.

The diameter of the openings inside the tube 31, preferably is a few millimetres, and can for example be about 2 millimetres. This may help to create a minor overpressure of a few Pa, for example about 3 Pa, in the bushing 30 in order to have an equal projection and distribution of the sterilization medium onto and over the surface of the shaft 11.

The advantageous flowing patterns occurring in the decontamination box according to the invention are also clearly shown in FIG. 4. There it can be seen that the sterilization medium can be brought in via the sterilization medium supply by using a manifold to maintain a certain flow rate of for example about 175 Nm3/hr (flow I). The sterilization medium is distributed inside the bushing (flow II). By causing an overpressure in this bushing and the perforated tube, an equal distribution of the sterilization medium over the surface of the shaft is created (flow III). After having sterilized the surface of the shaft, the sterilization medium is being exhausted by an under pressure in the suction chamber (flow IV). The under pressure also creates a flow out of the conditioned zone (flow V) to make sure no organisms enter the conditioned zone. A flow through a top plate of the suction chamber along the drive shafts prevents the mixture of the sterilization and conditioning media getting in the environment (flow V'). The different flows IV, V, IV' and V' are all led by the flow guides in the direction of the common discharge and there are exhausted due to under pressure in this central discharge (VII).

Besides the shown embodiments numerous variants are possible. For example the dimensions and shapes of the various components can be varied. The sterilization medium can be the same as the conditioning medium and for example be HPV. The media may also be different from each other. The amounts, speeds and pressures of the media supplied can be increased or decreased depending on the circumstances and depending on a required level of sterilization. Instead of the suction chamber being positioned directly adjacent the conditioned zone, it is also possible to provide some kind of distancing organ there between. Furthermore, in the case that it is no problem if some of the sterilization and conditioning media flow out of the suction chamber into the environment, than it is also possible to choose the pressure inside the suction chamber somewhat higher than the environmental pressure.

Thus the invention provides a relative simple, economic and user-friendly decontamination box provision for operating means of a container filling and/or closing device with which high levels of sterility up to aseptic conditions, can easily be obtained even for operating systems which have to perform somewhat more complex operations like combinations of translational and rotational movements.

The invention claimed is:

1. Device for the filling and/or closing of containers, under sterile or aseptic conditions, comprising:

a conditioned zone inside which operations to containers are to be performed, the conditioned zone connectable to a conditioned medium supply;

operating system for performing said operations, the operating system having a drive shaft unit being at least partially placed in an environment outside the conditioned zone, and the drive shaft being movable with at least part of the drive shaft into and out of the conditioned zone;

a decontamination box comprising an outer suction chamber and an inner sterilization chamber, the sterilization chamber lying at least partly inside the suction chamber, and the drive shaft extending at least partly through both the suction chamber and the sterilization chamber, the sterilization chamber connectable to a sterilization medium supply and the suction chamber being connectable to a media discharge for discharging the media from out of the decontamination box;

one or more outflow gaps connect the sterilization chamber to the suction chamber; and an inner inflow gap disposed in between the suction chamber and the drive shaft, which inner inflow gap connects the conditioned zone to the suction chamber.

2. Device according to claim 1, wherein the one or more outflow gaps comprise first and second outflow gaps that are provided at opposing ends along the drive shaft in between the sterilization chamber and the drive shaft, which first and second outflow gaps both connect the sterilization chamber to the suction chamber.

3. Device according to claim 1, wherein the sterilization chamber is delimited by a bushing inside which a distribution tube is placed, the sterilization medium supply connecting to a space lying in between the bushing and the distribution tube.

4. Device according to claim 3, wherein the distribution tube comprises a plurality of openings for sterilization medium to flow through towards the drive shaft.

5. Device according to claim 3, wherein the distribution tube is held centred inside the bushing by means of end rings.

6. Device according to claim 3, wherein the distribution tube fits with a play of between 1-5 millimetres around the drive shaft.

7. Device according to claim 1, wherein an outer inflow gap is provided in between the suction chamber and the drive shaft which connects the environment to the suction chamber.

8. Device according to 1, wherein a control unit is provided for regulating respective pressures of the conditioning and sterilization medium inside the respective chambers and conditioned zone such that media are forced to merely flow out of the decontamination box via the media discharge.

9. Device according to claim 1, wherein the operating system comprises a pick and place unit, a filling nozzle or a capping unit.

10. Device according to claim 1, wherein the sterilization medium supply is connected to the sterilization chamber.

11. Device according to claim 1, wherein the media discharge is connected to the suction chamber for discharging the media from out of the decontamination box.

12. Method for operating the device according to claim 1, comprising the steps of:

supplying conditioning medium into the conditioned zone;

supplying sterilization medium into the sterilization chamber;

sucking media out of the suction chamber;

moving the drive shaft into and out of the conditioned zone for performing operations to the containers, while keeping the drive shaft part sterilized.

13. Method according to claim 12, wherein the sterilization medium is supplied into the sterilization chamber at a pressure which is higher than a suction pressure at which the media are sucked out of the suction chamber.

14. Method according to claim 13, wherein the sterilization medium flows out of the sterilization chamber along the drive shaft into the suction chamber.

15. Method according to claim 12, wherein the media are sucked out of the suction chamber at a pressure which is lower than a pressure at which the conditioning medium is supplied into the conditioned zone.

16. Method according to claim 15, wherein the media are prevented from flowing out of the suction chamber along the drive shaft into the conditioned zone.

17. Method according to claim 12, wherein the media are sucked out of the suction chamber at a pressure which is lower than a pressure in the environment.

18. Method according to claim 17, wherein the media are prevented from flowing out of the suction chamber along the drive shaft into the environment.

* * * * *